US010993061B2

(12) United States Patent
Mariglio, III et al.

(10) Patent No.: US 10,993,061 B2
(45) Date of Patent: Apr. 27, 2021

(54) SOUNDSTAGE-CONSERVING AUDIO CHANNEL SUMMATION

(71) Applicant: Boomcloud 360, Inc., Encinitas, CA (US)

(72) Inventors: Joseph Mariglio, III, Encinitas, CA (US); Zachary Seidess, San Diego, CA (US)

(73) Assignee: Boomcloud 360, Inc., Encinitas, CA (US)

( * ) Notice: Subject to any disclaimer, the term of this patent is extended or adjusted under 35 U.S.C. 154(b) by 0 days.

(21) Appl. No.: 16/740,335

(22) Filed: Jan. 10, 2020

(65) Prior Publication Data

US 2020/0228910 A1 Jul. 16, 2020

Related U.S. Application Data

(60) Provisional application No. 62/791,626, filed on Jan. 11, 2019.

(51) Int. Cl.
*H04R 5/00* (2006.01)
*H04S 3/02* (2006.01)
(Continued)

(52) U.S. Cl.
CPC ..... *H04S 3/02* (2013.01); *H04R 3/12* (2013.01); *H04R 5/02* (2013.01); *H04R 5/04* (2013.01); *H04S 2400/01* (2013.01)

(58) Field of Classification Search
CPC ..... H04S 3/02; H04S 2400/01; H04R 3/12; H04R 5/02; H04R 5/04
(Continued)

(56) References Cited

U.S. PATENT DOCUMENTS

2010/0131278 A1 5/2010 Chu
2011/0142155 A1 6/2011 Mallik et al.
(Continued)

FOREIGN PATENT DOCUMENTS

TW I587289 B 6/2017
TW I591619 B 7/2017

OTHER PUBLICATIONS

Taiwan Intellectual Property Office, Office Action, TW Patent Application No. 109101109, dated Nov. 27, 2020, eight pages.
(Continued)

*Primary Examiner* — Ammar T Hamid
(74) *Attorney, Agent, or Firm* — Fenwick & West LLP

(57) ABSTRACT

An audio system provides for soundstage-conserving channel summation. The system includes circuitry that generates a first rotated component and a second rotated component by rotating a pair of audio signal components. The circuitry generates left quadrature components that are out of phase with each other using the first rotated component and generates right quadrature components that are out of phase with each other using the second rotated component. The circuitry generates orthogonal correlation transform (OCT) components based on the left and right quadrature components. Each OCT component including a weighted combination of a left quadrature component and a right quadrature component. The circuitry generates a mono output channel using one or more of the OCT components.

33 Claims, 6 Drawing Sheets

(51) Int. Cl.

| | |
|---|---|
| ***H04R 5/02*** | (2006.01) |
| ***H04R 5/04*** | (2006.01) |
| ***H04R 3/12*** | (2006.01) |

(58) Field of Classification Search
USPC ..... 381/16–20
See application file for complete search history.

(56) References Cited

U.S. PATENT DOCUMENTS

| | | | | |
|---|---|---|---|---|
| 2015/0221313 | A1 | 8/2015 | Purnhagen et al. | |
| 2016/0155448 | A1* | 6/2016 | Purnhagen | G10L 19/008 704/204 |
| 2017/0115955 | A1 | 4/2017 | Zalon et al. | |
| 2017/0115956 | A1 | 4/2017 | Zalon et al. | |
| 2017/0230777 | A1 | 8/2017 | Seldess et al. | |

OTHER PUBLICATIONS

Felsberg, M. et al., "Image Features Based on a New Approach to 2D Rotation Invariant Quadrature Filters," European Conference on Computer Vision, Apr. 29, 2002, pp. 1-15.
PCT International Search Report and Written Opinion, PCT Application No. PCT/US2020/013223, dated Apr. 24, 2020, nine pages.

* cited by examiner

SOUNDSTAGE-CONSERVING AUDIO CHANNEL SUMMATION

CROSS-REFERENCE TO RELATED APPLICATIONS

This application claims the benefit of U.S. Provisional Application No. 62/791,626, filed Jan. 11, 2019, which is incorporated by reference in its entirety.

FIELD OF THE INVENTION

This disclosure relates generally to audio processing, and more specifically to soundstage-conserving channel summation.

BACKGROUND

Audio content is typically designed for stereo playback. This assumption is problematic for playback solutions which do not conform to the expectations implied by this convention. Two such cases are mono speakers and multiple speakers arrayed in an unconstrained mesh. In both cases, a common solution is to sum both left and right channels of a stereo audio signal together, which results in the loss of negatively correlated information. Furthermore, in the case of the unconstrained mesh, the lack of knowledge about the mesh geometry results in a lost opportunity for preserving the soundstage information encoded in the original content.

SUMMARY

Embodiments relate to using nonlinear unitary filter-banks to provide soundstage-conserving channel summation and irregular mesh diffusion of audio signals. Mono summation via orthogonal correlation transform (also referred to herein as "MON-OCT") provides for soundstage-conserving channel summation. Applying the MON-OCT to an audio signal may include using a multi-input, multi-output non-linear unitary filter-bank which may be implemented in the time-domain for minimal latency and optimal transient response.

In some embodiments, a multi-band implementation of the mono summation via orthogonal correlation transform is used to reduce the artifacts associated with the nonlinear filters. A broadband audio signal may be broken into sub-bands, such as by using a phase-corrected 4th-order Linkwitz-Riley network, or other filter-bank topologies (e.g., wavelet decomposition or short-time-Fourier-transform (STFT)). The nonlinear dynamics of the filter can be described in terms of signal-dependent, time-varying linear dynamics. The unitary constraint ensures the stability of the filter under all conditions.

Some embodiments include a system including circuitry. The circuitry is configured to: generate a first rotated component and a second rotated component by rotating a pair of audio signal components; generate left quadrature components that are out of phase with each other using the first rotated component; generate right quadrature components that are out of phase with each other using the second rotated component; generate orthogonal correlation transform (OCT) components based on the left and right quadrature components, each OCT component including a weighted combination of a left quadrature component and a right quadrature component; generate a mono output channel using one or more of the OCT components; and provide the mono output channel to one or more speakers.

Some embodiments include a method. The method includes, by a circuitry: generating a first rotated component and a second rotated component by rotating a pair of audio signal components; generating left quadrature components that are out of phase with each other using the first rotated component; generating right quadrature components that are out of phase with each other using the second rotated component; generating orthogonal correlation transform (OCT) components based on the left and right quadrature components, each OCT component including a weighted combination of a left quadrature component and a right quadrature component; generating a mono output channel using one or more of the OCT components; and providing the mono output channel to one or more speakers.

Some embodiments include a non-transitory computer readable medium storing instructions that, when executed by at least one processor, configure the at least one processor to: generate a first rotated component and a second rotated component by rotating a pair of audio signal components; generate left quadrature components that are out of phase with each other using the first rotated component; generate right quadrature components that are out of phase with each other using the second rotated component; generate orthogonal correlation transform (OCT) components based on the left and right quadrature components, each OCT component including a weighted combination of a left quadrature component and a right quadrature component; generate a mono output channel using one or more of the OCT components; and provide the mono output channel to one or more speakers.

The figures depict various embodiments for purposes of illustration only. One skilled in the art will readily recognize from the following discussion that alternative embodiments of the structures and methods illustrated herein may be employed without departing from the principles described herein.

DETAILED DESCRIPTION

Audio Processing System

Figure 1:
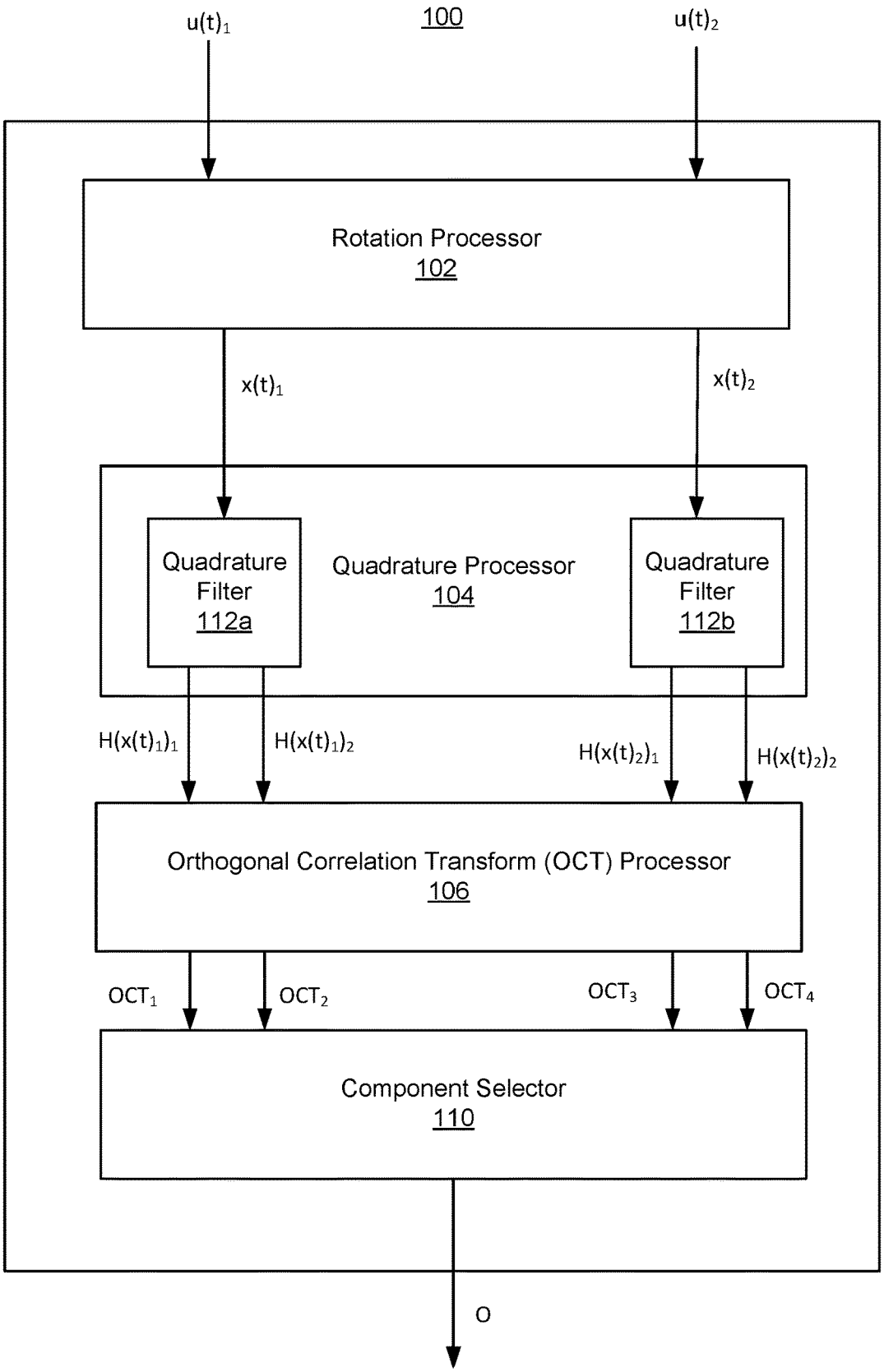
FIG. 1 is a block diagram of an audio processing system, in accordance with some embodiments.

FIG. 1 is a block diagram of an audio processing system 100, in accordance with some embodiments. The audio system 100 uses mono summation via orthogonal correlation transform ("MON-OCT") to provide soundstage-conserving channel summation. The audio processing system 100 includes a rotation processor 102, a quadrature processor 104, an orthogonal correlation transform (also referred to herein as "OCT") processor 106, and a component selector 108.

The rotation processor 102 receives an input signal u(t) including a left channel $u(t)_1$ and a right channel $u(t)_2$. The rotation processor 102 generates a first rotated component $x(t)_1$ by rotating a channel $u(t)_1$ and a channel $u(t)_2$, and a second rotated component $x(t)_2$ by rotating the channel $u(t)_1$ and the channel $u(t)_2$. The channels $u(t)_1$ and $u(t)_2$ are a pair of audio signal components. In one example, the channel $u(t)_1$ is a left channel and the channel $u(t)_2$ is a right channel of a stereo audio signal.

The quadrature processor 104 includes a quadrature filter for each of the rotated components. The quadrature filter 112*a* receives the first rotated component $x(t)_1$, and generates left quadrature components $H(x(t)_1)_1$ and $H(x(t)_1)_2$ having a (e.g., 90 degree) phase relationship between each other, and each having a unity magnitude relationship with the first rotated component $x(t)_1$. The quadrature filter 112*b* receives the second rotated component $x(t)_2$, and generates right quadrature components $H(x(t)_2)_1$ and $H(x(t)_2)_2$ having a (e.g., 90 degree) phase relationship between each other, and each having a unity magnitude relationship with the second rotated component $x(t)_2$.

The OCT processor 106 receives the quadrature components $H(x(t)_1)_1$, $H(x(t)_1)_2$, $H(x(t)_2)_1$, and $H(x(t)_2)_2$, and combines pairs of the quadrature components using weights to generate OCT components $OCT_1$, $OCT_2$, $OCT_3$, and $OCT_4$. The number of OCT components may correspond with the number of quadrature components. Each OCT component includes contributions from the left channel $u(t)_1$ and the right channel $u(t)_2$ of the input signal u(t), but without loss of negatively correlated information that would result by simply combining the left channel $u(t)_1$ and the right channel $u(t)_2$. The use of quadrature components results in summations where amplitude nulls are converted into phase nulls.

The component selector 110 generates a mono output channel O using one or more of the OCT components $OCT_1$, $OCT_2$, $OCT_3$, and $OCT_4$. In some embodiments, the component selector 110 selects one of the OCT components for the output channel O. In other embodiments, the component selector 110 generates the output channel O based on combinations of a plurality of OCT components. For example, multiple OCT components may be combined in the output channel 0, with different OCT components being weighted differently over time. Here, the output channel O is a time varying combination of multiple OCT components.

As such, the audio processing system 100 generates the output channel O from the input signal u(t) including the left channel $u(t)_1$ and the right channel $u(t)_2$. The input signal u(t) may include various numbers of channels. For an n channel input signal, the audio processing system 100 may generate 2n quadrature components and 2n OCT components, and generate an output channel O using one or more of the 2n OCT components.

Linear Mono Summation Via Orthogonal Correlation Transformation

In some embodiments, a linear, time invariant form of OCT (e.g., as defined in equation 7) may be used to generate a mono output channel from an audio signal including multiple (e.g., n) channels.

A stereo audio signal may be defined according to Equation 1:

$$u(t) \equiv [u(t)_1 u(t)_2] \equiv [LR] \tag{1}$$

where $u(t)_1$ may be a left channel L of the stereo audio signal, and $u(t)_2$ may be a right channel R of the stereo audio signal. In other embodiments, the $u(t)_1$ and $u(t)_2$ are a pair of audio signal components other than left and right channels.

If a linear projection from this two-dimensional signal were applied into a single dimension, we should expect a nullspace. The common solution of summing both channels does precisely this. As a result, the nullspace contains vectors of the form $u(t)_1 = -u(t)_2$.

To generate the rotated components x(t) from input audio signal u(t) (e.g., by the rotation processor 102), a rotation matrix is applied. For n=2 channels, a 2×2 orthogonal rotation matrix may be defined by Equation 2:

$$R_2(\theta) \equiv \begin{bmatrix} \cos & -\sin\theta \\ \sin\theta & \cos\theta \end{bmatrix} \tag{2}$$

where θ determines the angle of rotation. In one example the angle of rotation θ is 45°, resulting in each input signal component being rotated by 45°. In other examples the angle of rotation may be −45°, resulting in a rotation in the opposite direction. In some examples (e.g., as shown in Equation 11 below), the angle of rotation varies with time, or in response to the input signal. However, in this particular case, the rotation is fixed, and it is applied to u(t) to result in x(t) as defined by Equation 3:

$$x(t) = u(t) R_2\left(\frac{\pi}{4}\right) \tag{3}$$

To generate quadrature components (e.g., by the quadrature processor 104), a quadrature all-pass filter function H ( ) including a pair of quadrature all-pass filters (e.g., quadrature filters 112*a* and 112*b*) for each channel is defined using a continuous-time prototype. For the channel $x(t)_1$, for example, the quadrature all-pass filter function may be defined according to Equation 4:

$$\mathcal{H}(u(t)) \equiv [\mathcal{H}(u(t))_1 \mathcal{H}(u(t))_2] \equiv \left[\tilde{u}(t) \frac{1}{\pi} \int_{-\infty}^{\infty} \frac{\tilde{u}(\tau)}{t-\tau} dt\right] \tag{4}$$

where H ( ) is a linear operator including the two quadrature all-pass filters $H(\ )_1$ and $H(\ )_2$. $H(\ )_1$ generates a component having a 90 degrees phase relationship with a component generated by $H(\ )_2$, and the outputs of $H(\ )_1$ and $H(\ )_2$ are referred to as quadrature components. $\tilde{x}(t)_1$ is a signal with the same magnitude spectrum as $x(t)_1$, but with an unconstrained phase relationship to $x(t)_1$.

The quadrature components defined by $H(x(t)_1)_1$ and $H(x(t)_1)_2$ have the 90 degrees phase relationship between each other, and each has a unity magnitude relationship with the input channel $x(t)_1$. Similarly, a quadrature all-pass filter function H ( ) may be applied to the channel $x(t)_2$ to generate quadrature components, defined by $H(x(t)_2)_1$ and $H(x(t)_2)_2$, having the 90 degrees phase relationship between each other, and each having a unity magnitude relationship with the input channel $x(t)_2$.

The audio signal u(t) is not limited to two (e.g., left and right) channels, and could contain n channels. Thus, the dimensionality of x(t) is also variable. More generally, a linear quadrature all-pass filter function $H_n(x(t))$ may be defined by its action on an n-dimensional vector x(t) including n channel components. The result is a row-vector of dimension 2n defined by Equation 5:

$$H_n(x(t)) \equiv \begin{bmatrix} \mathcal{H}(x(t)_1)_1 \\ \mathcal{H}(x(t)_1)_2 \\ \mathcal{H}(x(t)_2)_1 \\ \mathcal{H}(x(t)_2)_2 \\ \vdots \\ \mathcal{H}(x(t)_n)_1 \\ \mathcal{H}(x(t)_n)_2 \end{bmatrix}^T \tag{5}$$

where $H(\ )_1$ and $H(\ )_2$ are defined according to Equation 4 above. Here, a pair of quadrature components having a 90 degrees phase relationship is generated for each of the n channels of the audio signal. As such, the quadrature all-pass filter function $H_n(\ )$ projects an n dimensional vector of the audio signal u(t) into a 2n dimensional space.

To generate the OCT outputs from the quadrature components (e.g., by OCT processor 106), a rotation is applied to each of the quadrature components. Rotation matrices are applied in block form with a permutation matrix to generate a fixed matrix P as defined by Equation 6:

$$P \equiv \begin{bmatrix} 1 & 0 & 0 & 0 \\ 0 & 0 & 1 & 0 \\ 0 & 0 & 0 & 1 \\ 0 & 1 & 0 & 0 \end{bmatrix} \begin{bmatrix} R_2(-\frac{\pi}{4}) & \\ & R_2(-\frac{\pi}{4}) \end{bmatrix} = \begin{bmatrix} 1 & 1 & 0 & 0 \\ 0 & 0 & 1 & 1 \\ 0 & 0 & -1 & 1 \\ -1 & 1 & 0 & 0 \end{bmatrix} \frac{1}{\sqrt{2}} \tag{6}$$

The fixed matrix P is multiplied with the quadrature components of $H_n(x(t))$. When u(t) is stereo signal (e.g., n=2), and thus the dimensionality of x(t) is also 2, this 4×4 orthonormal matrix P transforms a 4-dimensional vector result of $H_2$ (x(t)) into a 4-dimensional basis defined by four orthogonal components: the OCT components. For example, a first left quadrature component may be combined with an inverted second right quadrature component to generate a first OCT component, a first left quadrature component may be combined with a second right quadrature component to generate a second OCT component, a second left quadrature component may be combined with an inverted first right quadrature component to generate a third OCT component, and a second left quadrature component may be combined with a first right quadrature component to generate a fourth OCT component. As such, pairs of quadrature components are weighted and combined to generate the OCT components. For an audio signal u(t) with more than two channels, larger rotation and permutation matrices may be used to generate a fixed matrix of the correct size. The general equation for deriving the OCT components is defined by Equation 7:

$$M(u(t)) \equiv H_2\left(u(t)R_2\left(\frac{\pi}{4}\right)\right)P \tag{7}$$

To generate a mono output channel (e.g., by the component selector 110), one of the outputs generated from the OCT may be selected. The mono output channel is provided to a speaker, or multiple speakers.

Nonlinear Mono Summation Via Orthogonal Correlation Transformation

Simply transforming a 2-dimensional audio vector as described above and selecting a single output will still result in a nullspace. However, for many real-world examples, the odds of having perceptually significant audio information in these subspaces are much worse than the odds of having significant information in a location such as L+R or L−R. This is because of common mixing techniques that have become industry standard.

It is still possible that an OCT output will be missing salient information. To address this, a nonlinear sum may be used, which can be written as a signal dependent, time varying combination of two or more OCT outputs.

For example, the component selector 110 may select two of the OCT outputs and use the selected OCT outputs to generate a nonlinear sum. To enumerate the possible combinations when MON-OCT is applied to a two-channel audio signal u(t) resulting in four OCT outputs, a 4×2 projection matrix Π may be used to select a pair of components from the four OCT outputs. The selected components correspond with the nonzero indices in the projection matrix, for example, as shown by Equation 8:

$$\prod_{2,3} \equiv \begin{bmatrix} 0 & 0 \\ 1 & 0 \\ 0 & 1 \\ 0 & 0 \end{bmatrix} \tag{8}$$

In this example, the projection matrix Π selects the second and third OCT outputs to generate a two-dimensional vector of orthogonal components $M_a(u)$ and $M_b(u)$, as shown by Equation 9:

$$[M_a(u)\ M_b(u)] \equiv H_2\left([L\ R]R_2\left(\frac{\pi}{4}\right)\right)P\prod_{a,b} \tag{9}$$

The resulting 2-dimensional vector is combined to generate the mono output channel by using a time-varying rotation which depends on the input signal. To temper the nonlinear effect of instantaneous change in rotation angle, let S(x) denote a slope limiting function such as a linear or nonlinear low-pass filter, slew limiter, or some similar element. The action of this filter is to place an upper limit on the absolute frequency of the resulting modulating sinusoid, effectively limiting the maximum nonlinearity resulting from the rotation.

Although many different tests for local optimality could be used, in one example, the peak absolute value between the two orthogonal components is used as input to the slope limiting function S to determine an angle $\vartheta_u$, as defined by Equation 10.

$$\vartheta_u \equiv \frac{\pi}{4}S(|M_a(u)| < |M_b(u)|) \tag{10}$$

Other embodiments may use a different measure of optimality as input to the slope limiting function S(x). The angle $\vartheta_u$ points toward a dynamically changing optimum given u. This optimum is extracted with a projection to generate the mono output channel $\tilde{M}_{a,b}(u)$, as defined by Equation 11:

$$\tilde{M}_{a,b}(u) \equiv [M_a(u)\ M_b(u)]R_2(\vartheta_u)\begin{bmatrix} 1 \\ 0 \end{bmatrix} \tag{11}$$

Although the projection matrix Π is discussed above as selecting the second and third of the four orthogonal components output from the MON-OCT, any of the OCT outputs may be selected among to generate the mono output channel. In some embodiments, multiple OCT outputs may be selected and provided to different speakers. In some embodiments, orthogonal components may be selected for combination based on other factors, such as RMS maximization or other functions. In some embodiments, Equation 11 does not project but merely rotates the vector $[M_a(u)\ M_b(u)]$, which results in multi-channel output.

Minimization of Artifacts Via Subband Decomposition

The mono output channel defined by Equation 11 may include nonlinear artifacts which are the result of frequency shifting by the angular velocity of $\vartheta_u$. This may be mitigated by applying a subband decomposition, where the wideband audio signal u(t) is separated into frequency subband components. The MON-OCT may then be performed on each of the subbands, with the results for each of the subbands being combined into the mono output channel. A frequency band divider may be used to separate the audio signal into subbands. After applying MON-OCT to each of the subbands, a frequency band combiner may be used to combine the subbands into an output channel.

Subband decomposition provides for reducing the nonlinear artifacts. A trade-off can occur between salient and transient response, but for all practical purposes an optimal region is small enough to be set without further parameterization.

Figure 2:
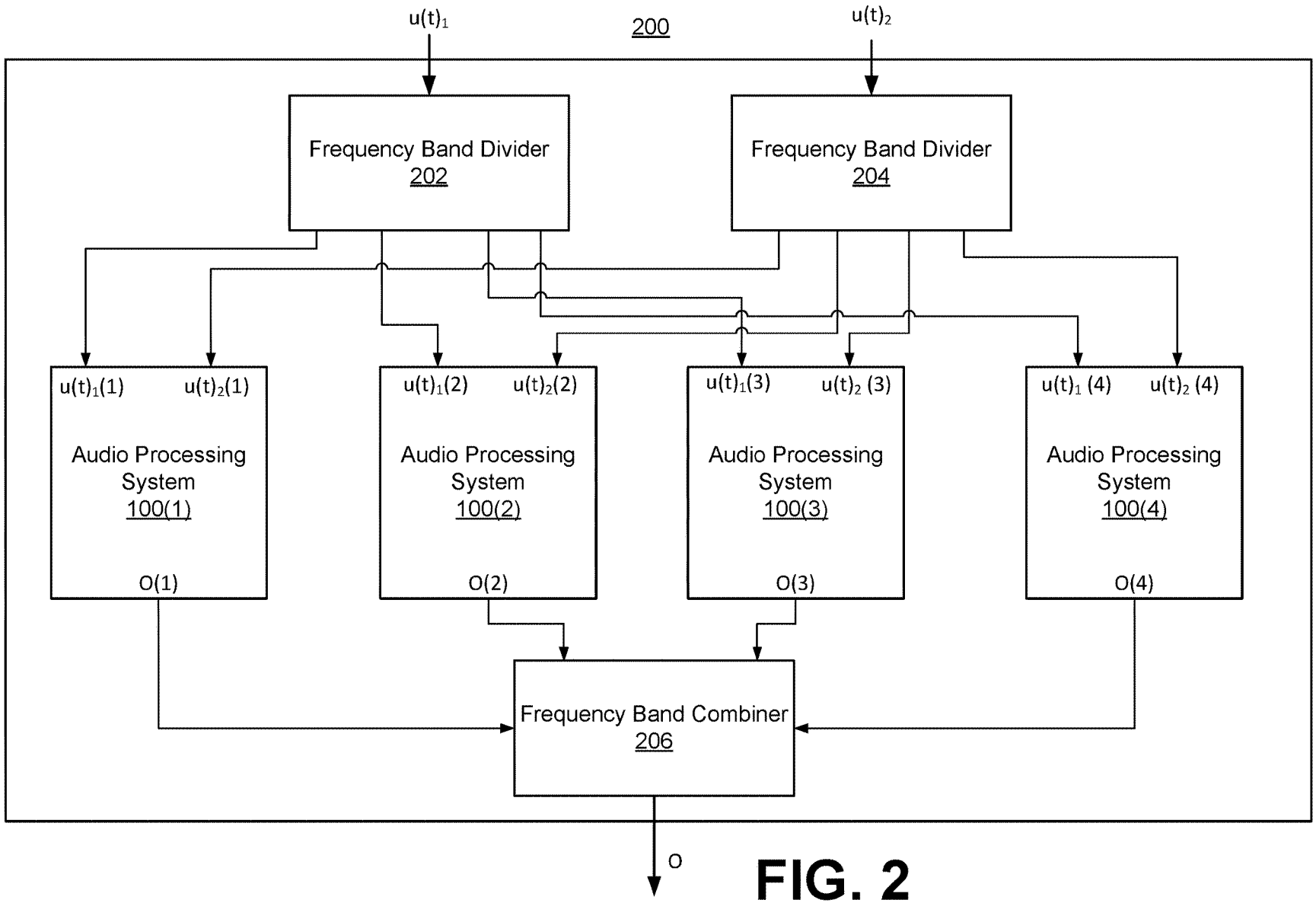
FIG. 2 is a block diagram of an audio processing system, in accordance with some embodiments.

FIG. 2 is a block diagram of an audio processing system 200, in accordance with some embodiments. The audio processing system 200 includes a frequency band divider 202, a frequency band divider 204, audio processing systems 100(1) through 100(4), and a frequency band combiner 206.

The frequency band divider 202 receives a left channel $u(t)_1$ of an input signal u(t), and separates the left channel $u(t)_1$ into left subband components $u(t)_1$ (1), $u(t)_1$(2), $u(t)_1$(3), and $u(t)_1$(4). Each of the four left subband components $u(t)_1$(1), $u(t)_1$(2), $u(t)_1$(3), and $u(t)_1$(4) includes audio data of a different frequency band of the left channel $u(t)_1$. The frequency band divider 204 receives a right channel $u(t)_2$ of the input signal u(t), and separates the right channel $u(t)_2$ into right subband components $u(t)_2$(1), $u(t)_2$(2), $u(t)_2$(3), and $u(t)_2$(4). Each of the four right subband components $u(t)_2$(1), $u(t)_2$(2), $u(t)_2$(3), and $u(t)_2$(4) includes audio data of a different frequency band of the right channel $u(t)_2$.

Each of the audio processing systems 100(1), 100(2), 100(3), and 100(4) receives a left subband component and a right subband component, and generates a mono subband component for the subband based on the left and right subband components. The discussion regarding the audio processing system 100 above in connection with FIG. 1 may be applicable to each of the audio processing systems 100(1), 100(2), 100(3), and 100(4), except that the operations are performed on subband of the left and right channels instead of the entire left channel $u(t)_1$ and right channel $u(t)_2$.

The audio processing system 100(1) receives the left subband component $u(t)_1$(1) and the right subband component $u(t)_2$(1), and generates a mono subband component O(1). The audio processing system 100(2) receives the left subband component $u(t)_1$(2) and the right subband component $u(t)_2$(2), and generates a mono subband component O(2). The audio processing system 100(3) receives the left subband component $u(t)_1$(3) and the right subband component $u(t)_2$(3) and generates a mono subband component O(3). The audio processing system 100(4) receives the left subband component $u(t)_1$(4) and the right subband component $u(t)_2$(4), and generates a mono subband component O(4). The processing performed by the audio processing systems 100(1) through 100(4) may be different for different subband components.

The frequency band combiner 206 receives the mono subband components O(1), O(2), O(3), and O(4), and combines these mono subband components into a mono output channel O.

Figure 3:
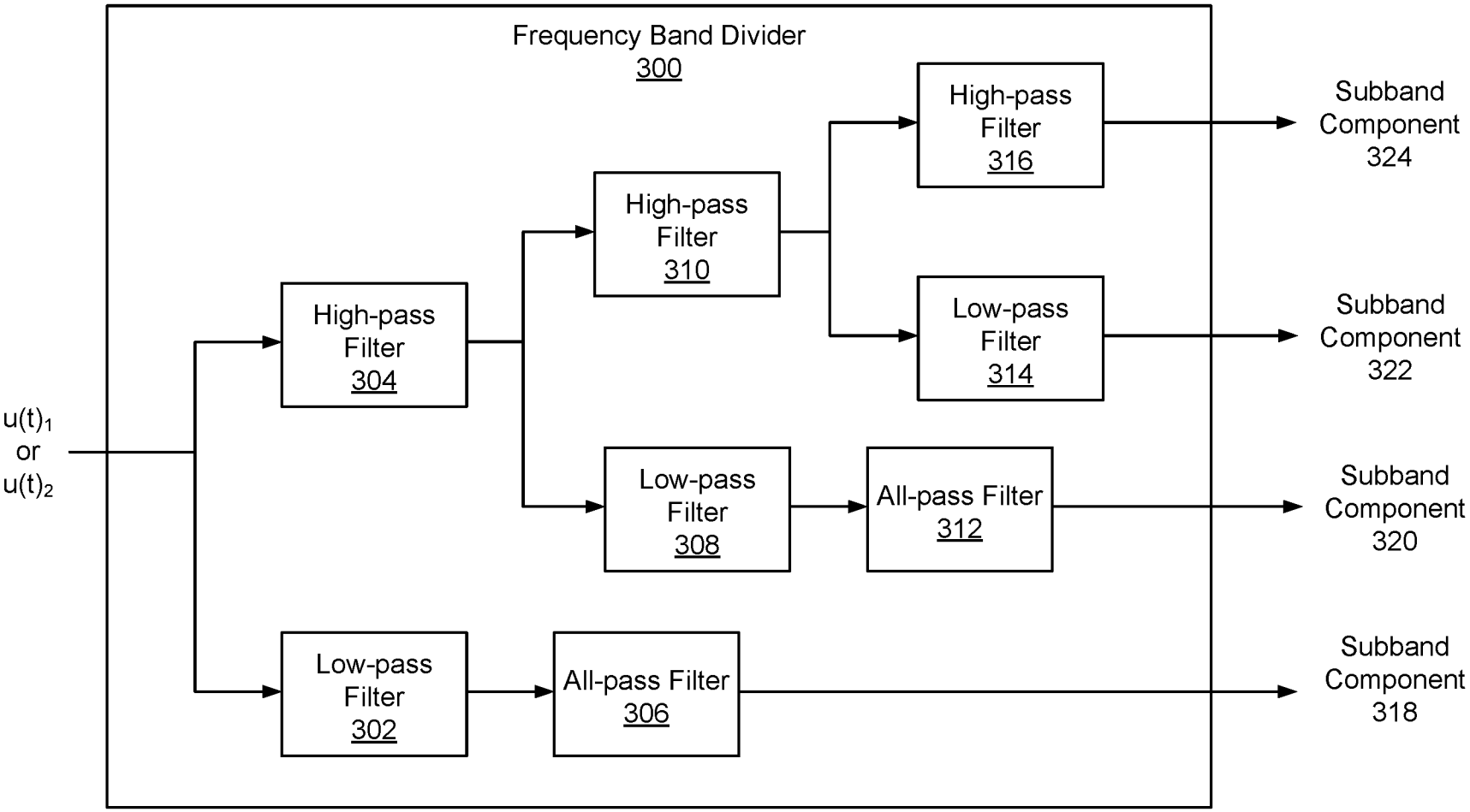
FIG. 3 is a block diagram of a frequency band divider, in accordance with some embodiments.

FIG. 3 is a block diagram of a frequency band divider 300, in accordance with some embodiments. The frequency band divider 300 is an example of a frequency band divider 202 or 204. The frequency band divider 300 is a $4^{th}$-order Linkwitz-Riley crossover network with phase-corrections applied at corner frequencies. The frequency band divider 300 separates an audio signal (e.g., left channel $u(t)_1$ and a right channel $u(t)_2$) into subband components 318, 320, 322, and 324.

The frequency band divider includes a cascade of $4^{th}$ order Linkwitz-Riley crossovers with phase correction to allow for coherent summing at the output. The frequency band divider 300 includes a low-pass filter 302, a high-pass filter 304, an all-pass filter 306, a low-pass filter 308, a high-pass filter 310, an all-pass filter 312, a high-pass filter 316, and a low-pass filter 314.

The low-pass filter 302 and high-pass filter 304 include $4^{th}$ order Linkwitz-Riley crossovers having a corner frequency (e.g., 300 Hz), and the all-pass filter 306 includes a matching $2^{nd}$ order all-pass filter. The low-pass filter 308 and high-pass filter 310 include $4^{th}$ order Linkwitz-Riley crossovers having another corner frequency (e.g., 510 Hz), and the all-pass filter 312 includes a matching $2^{nd}$ order all-pass filter. The low-pass filter 314 and high-pass filter 316 include $4^{th}$ order Linkwitz-Riley crossovers having another corner frequency (e.g., 2700 Hz). As such, the frequency band divider 300 produces the subband component 318 corresponding to the frequency subband(1) including 0 to 300 Hz, the subband component 320 corresponding to the frequency subband(2) including 300 to 510 Hz, the subband component 322 corresponding to the frequency subband(3) including 510 to 2700 Hz, and the subband component 324 corresponding to the frequency subband(4) including 2700 Hz to Nyquist frequency. In this example, the frequency band divider 300 generates n=4 subband components. The number of subband components and their corresponding frequency ranges generated by the frequency band divider 300 may vary. The subband components generated by the frequency band divider 300 allow for unbiased perfect summation, such as by the frequency band combiner 206.

Mono Summation Via Orthogonal Correlation Transformation for Unconstrained Mesh Networks The audio processing system 100 provides a multi-input, multi-output nonlinear filter-bank which has been designed to preserve perceptually important components of the soundstage (in some embodiments defined by equation (11), with the linear form defined by equation (7)), where the optimality condition may be satisfied by using more than one output. This implies that audio can be distributed to a mesh of single- or multi-driver speakers, without concern regarding number or placement, and still hope to reproduce a compelling but multi-centered spatial experience of that audio signal. Different nonlinear sums may be selected for each subband, and these associations between subband and nonlinear sum may be permuted for each output. For example, four nonlinear sums (a,b,c,d) my be used to generate three independent outputs comprised of two subbands each (e.g., output1=[subband1, subband2]), then the nonlinear sums for each subband may be permuted using output1=[a, b], output2=[b, c], output3=[c, d]. Depending on the optimality condition and the number of constituent subbands, this could result in a large number of unique signals, each of which contains a slight variation on the same perceptual whole. When each is played alone, the diffused signals each reproduce the entire soundstage. When played simultaneously, such as using a mesh of multiple speakers, the diffused signal takes on an unbiased but undoubtedly spatial quality.

In some embodiments, for a mesh of speakers, one of the outputs generated using MON-OCT may be provided to each of the speakers. In some embodiments, pairs of orthogonal components are used to generate nonlinear sums (e.g., each sum being a mono output channel as defined by Equation 11) defining the mono output channels, with different mono output channels being provided to each of the speakers of the mesh.

Example Processes

Figure 4:
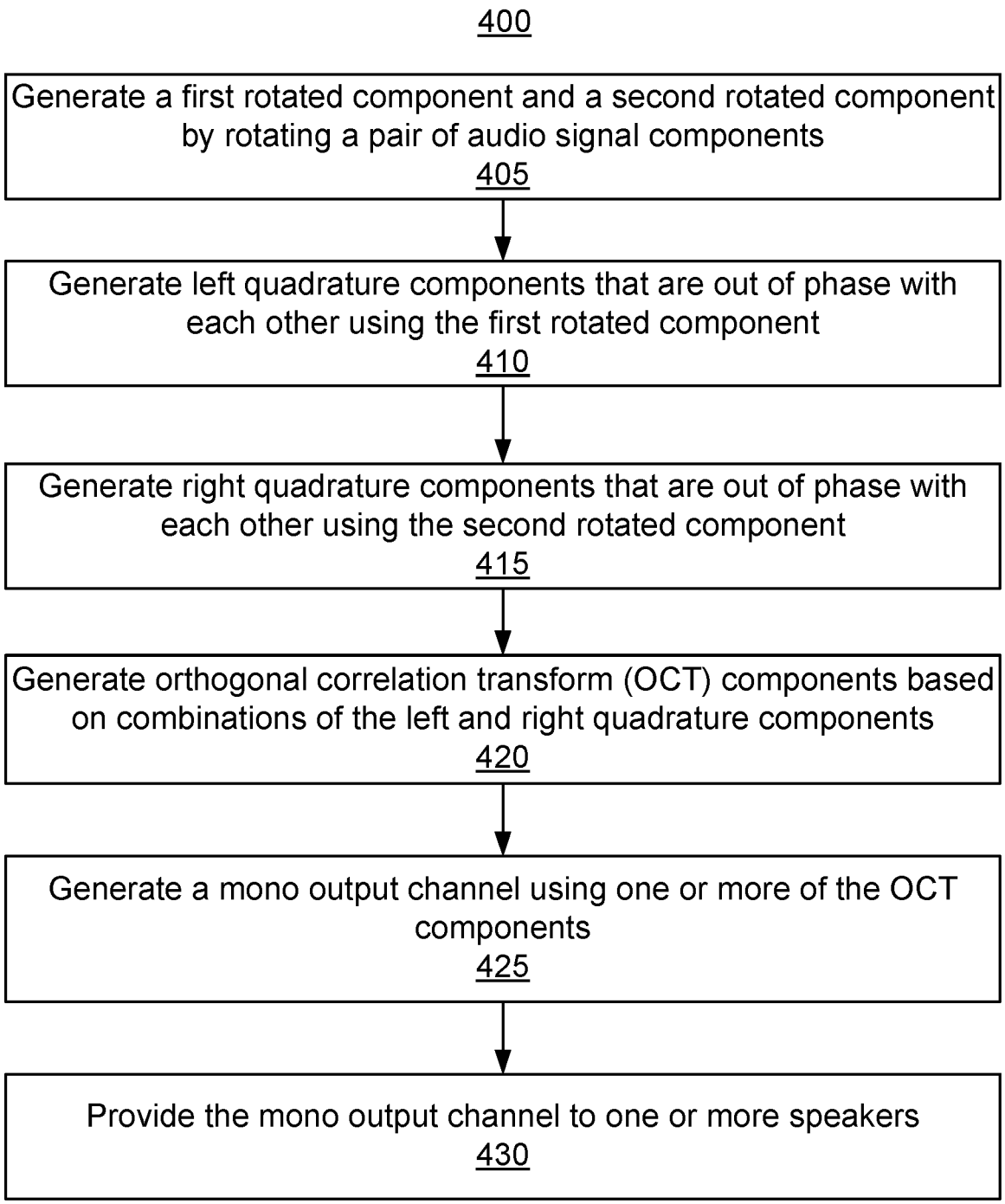
FIG. 4 is a flowchart of a process for soundstage-conserving channel summation, in accordance with some embodiments.

FIG. 4 is a flowchart of a process 400 of soundstage-conserving channel summation, in accordance with some embodiments. The process shown in FIG. 4 may be performed by components of an audio processing system (e.g., audio processing system 100). Other entities may perform some or all of the steps in FIG. 4 in other embodiments. Embodiments may include different and/or additional steps, or perform the steps in different orders.

The audio processing system generates 405 generates a first rotated component and a second rotated component by rotating a pair of audio signal components. In one example, the pair of audio signal components include a left audio signal component and a right audio signal component of a stereo audio signal. The rotation may use a fixed angle, or the angle of rotation may vary with time. The left component may include a (e.g., wideband) left channel and the right component may include a (e.g., wideband) right channel. In some embodiments and as discussed in greater detail with reference to FIG. 5, the left component may include a left subband component and the right component may include a right subband component. The pair of audio signal components are not limited to left and right channels, and other types of audio signals and audio signal component pairs may be used.

The audio processing system generates 410 left quadrature components that are out of phase with each other using the first rotated component. The left quadrature components may have a 90 degrees phase relationship between each other. In some embodiments, the audio processing system generates components having some other phase relationship using the first rotated component, and these components may be processed in a similar way as discussed herein for the left quadrature components. The left quadrature components may each have a unity magnitude relationship with the first rotated component. The audio processing system may apply an all-pass filter function to generate the left quadrature components using the first rotated component.

The audio processing system generates 415 right quadrature components that are out of phase with each other using the second rotated component. The right quadrature components may have a 90 degrees phase relationship between each other. In some embodiments, the audio processing system generates components having some other phase relationship using the second rotated component, and these components may be processed in a similar way as discussed herein for the right quadrature components. The right quadrature components may each have a unity magnitude relationship with the second rotated component. The audio processing system may apply an all-pass filter function to generate the right quadrature components using the second rotated component.

The audio processing system generates 420 orthogonal correlation transform (OCT) components based on the left and right quadrature components, where each OCT component includes a weighted combination of a left quadrature component and a right quadrature component. For example, the audio processing system applies a weight to a left quadrature component and a weight to a right quadrature component, and combines the weighted left and right quadrature components to generate an OCT component. Different combinations of weighted left and right quadrature components may be used to generate different OCT components. The number of OCT components may correspond with the number of quadrature components. Each OCT component includes contributions from the left channel and the right channel of the input signal, but without loss of negatively correlated information that would result by simply combining the left channel and the right channel.

The audio processing system 425 generates a mono output channel using one or more of the OCT components. For example, one of the OCT components may be selected as the mono output channel. In another example, the output channel may include a time varying combination of two or more OCT components.

The audio processing system provides 430 the mono output channel to one or more speakers. For example, the mono output channel may be provided to a speaker of a single speaker system, or multiple speakers of a multiple speaker system. In some embodiments, different mono output channels may be generated and provided to different speakers of a mesh. For example, one of each of the OCT components may be provided to each of the speakers. In another example, pairs of OCT components are used to generate nonlinear sums, with different nonlinear sums being provided to each of the speakers of the mesh Although the process 400 is discussed using left and right channels, the number of channels in the audio signal may vary. A pair of quadrature components having a 90 degrees phase relationship is generated for each of the n channels of the audio signal, and a mono output channel may be generated based on the quadrature components.

Figure 5:
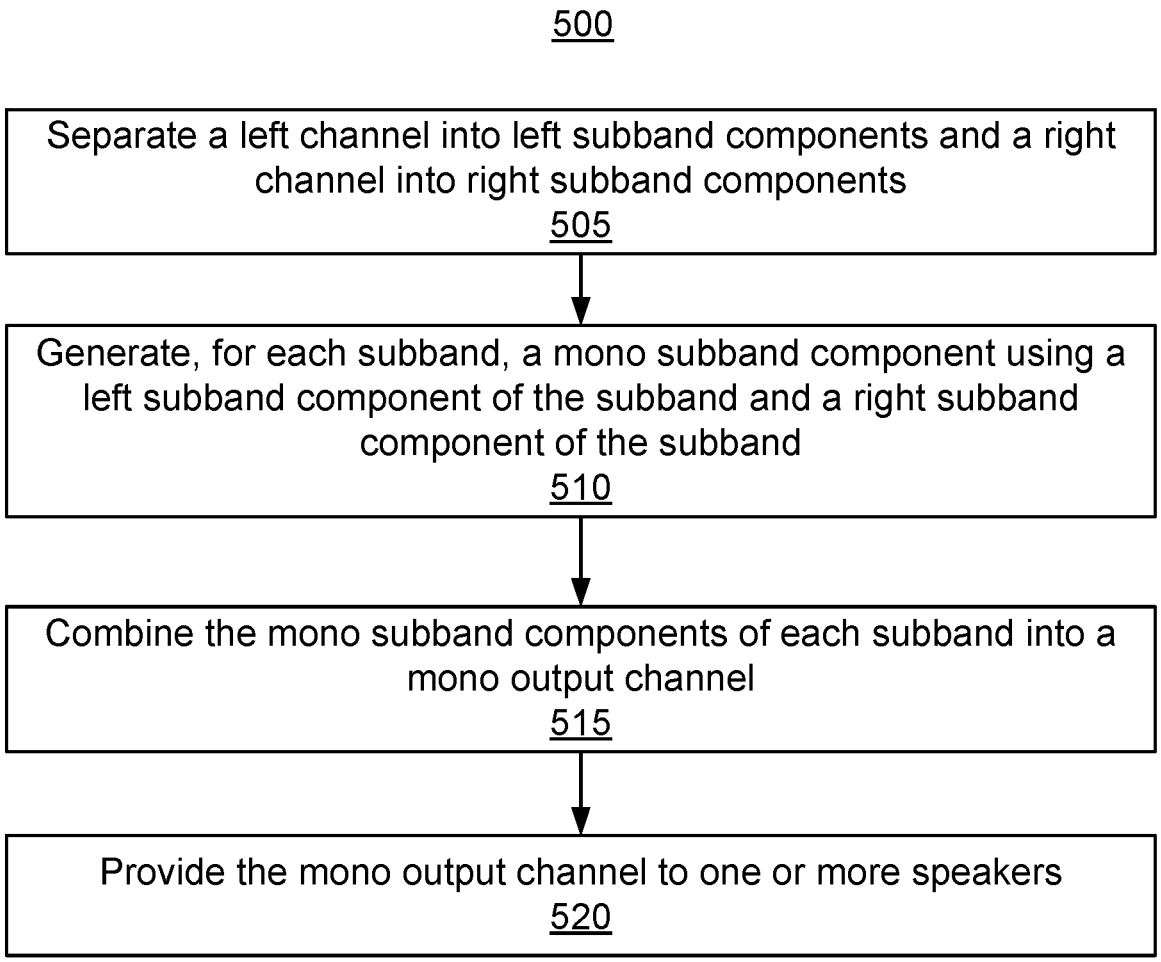
FIG. 5 is a flowchart of a process for soundstage-conserving channel summation with subband decomposition, in accordance with some embodiments

FIG. 5 is a flowchart of a process 500 of soundstage-conserving channel summation with subband decomposition, in accordance with some embodiments. The process shown in FIG. 5 may be performed by components of an audio processing system (e.g., audio processing system 200). Other entities may perform some or all of the steps in FIG. 5 in other embodiments. Embodiments may include different and/or additional steps, or perform the steps in different orders.

The audio processing system separates 505 a left channel into left subband components and a right channel into right subband components. In one example, each of the left and right channels are separated into four subband components. The number of subbands and associated frequency ranges of the subbands may vary.

The audio processing system generates 510, for each subband, a mono subband component using a left subband component of the subband and a right subband component of the subband. For example, the audio processing system may perform steps 405 through 425 of the process 400 for each subband to generate a mono subband component for the subband. In some embodiments, different nonlinear sums of OCT components may be selected for different subbands to generate the mono subband components. Depending on the optimality condition and the number of constituent subbands, this could result in a large number of possible unique broadband signals, each of which contains a slight variation on the same perceptual whole.

The audio processing system 515 combines the mono subband components of each subband into a mono output channel. For example, the mono subband components may be added to generate the mono output channel.

The audio processing system provides 520 the mono output channel to one or more speakers. The one or more speakers may include a single speaker, or a mesh of speakers. In some embodiments, the audio processing system provides different mono output channels for different speakers.

Example Computer

Figure 6:
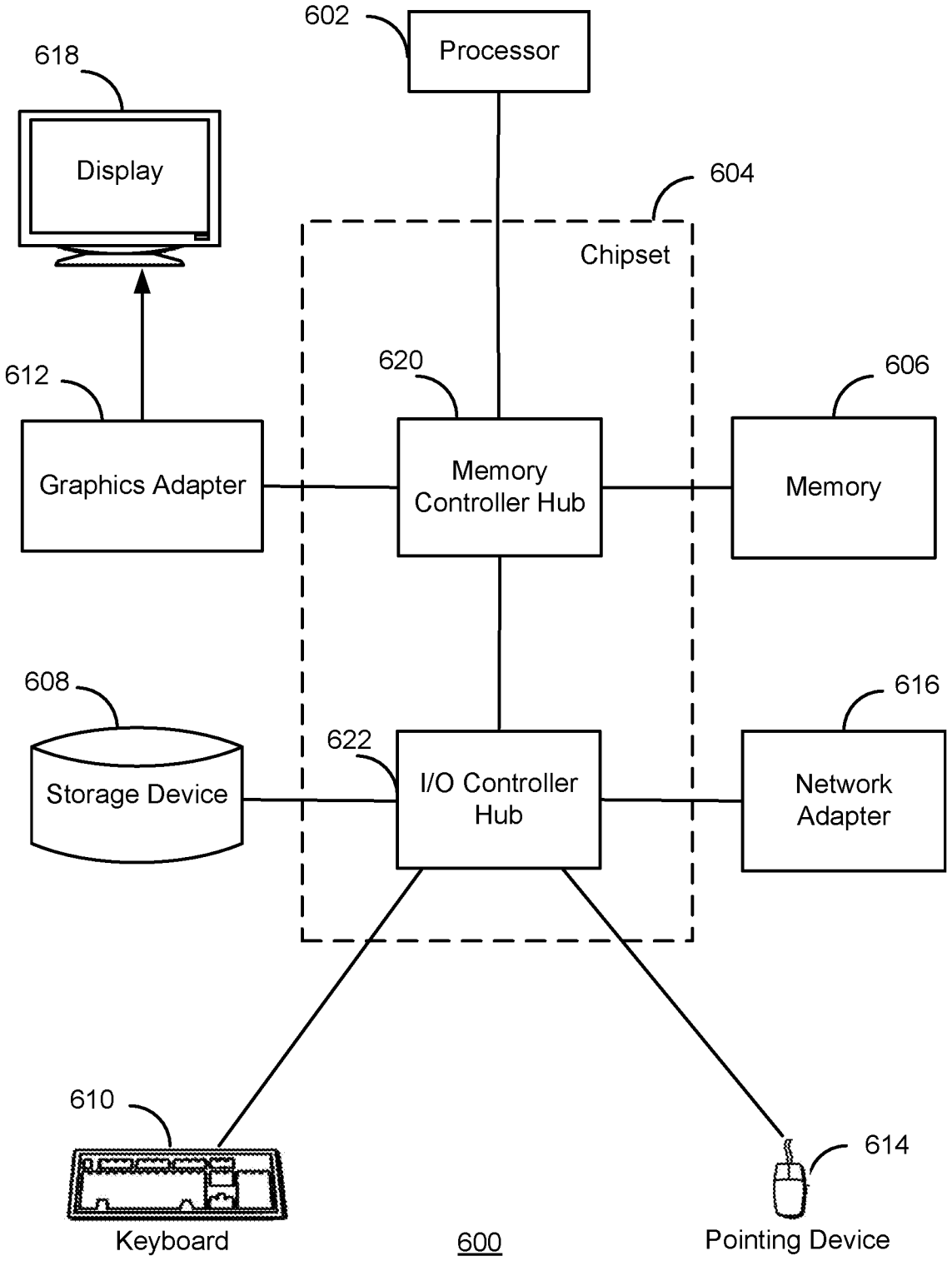
FIG. 6 is a block diagram of a computer, in accordance with some embodiments.

FIG. 6 is a block diagram of a computer 600, in accordance with some embodiments. The computer 600 is an example of circuitry that implements an audio processing system, such as the audio processing system 100 or 200. Illustrated are at least one processor 602 coupled to a chipset 604. The chipset 604 includes a memory controller hub 620 and an input/output (I/O) controller hub 622. A memory 606 and a graphics adapter 612 are coupled to the memory controller hub 620, and a display device 618 is coupled to the graphics adapter 612. A storage device 608, keyboard 610, pointing device 614, and network adapter 616 are coupled to the I/O controller hub 622. The computer 600 may include various types of input or output devices. Other embodiments of the computer 600 have different architectures. For example, the memory 606 is directly coupled to the processor 602 in some embodiments.

The storage device 608 includes one or more non-transitory computer-readable storage media such as a hard drive, compact disk read-only memory (CD-ROM), DVD, or a solid-state memory device. The memory 606 holds program code (comprised of one or more instructions) and data used by the processor 602. The program code may correspond to the processing aspects described with reference to FIGS. 1 through 5.

The pointing device 614 is used in combination with the keyboard 610 to input data into the computer system 600. The graphics adapter 612 displays images and other information on the display device 618. In some embodiments, the display device 618 includes a touch screen capability for receiving user input and selections. The network adapter 616 couples the computer system 600 to a network. Some embodiments of the computer 600 have different and/or other components than those shown in FIG. 6.

In some embodiments, the circuitry that implements an audio processing system, such as the audio processing system 100 or 200, may include an application-specific integrated circuit (ASIC), a field-programmable gate array (FPGA), or other types of computing circuitry.

Additional Considerations

The foregoing description of the embodiments has been presented for illustration; it is not intended to be exhaustive or to limit the patent rights to the precise forms disclosed. Persons skilled in the relevant art can appreciate that many modifications and variations are possible considering the above disclosure.

Some portions of this description describe the embodiments in terms of algorithms and symbolic representations of operations on information. These algorithmic descriptions and representations are commonly used by those skilled in the data processing arts to convey the substance of their work effectively to others skilled in the art. These operations, while described functionally, computationally, or logically, are understood to be implemented by computer programs or equivalent electrical circuits, microcode, or the like. Furthermore, it has also proven convenient at times, to refer to these arrangements of operations as modules, without loss of generality. The described operations and their associated modules may be embodied in software, firmware, hardware, or any combinations thereof.

Any of the steps, operations, or processes described herein may be performed or implemented with one or more hardware or software modules, alone or in combination with other devices. In one embodiment, a software module is implemented with a computer program product comprising a computer-readable medium containing computer program code, which can be executed by a computer processor for performing any or all the steps, operations, or processes described.

Embodiments may also relate to an apparatus for performing the operations herein. This apparatus may be specially constructed for the required purposes, and/or it may comprise a general-purpose computing device selectively activated or reconfigured by a computer program stored in the computer. Such a computer program may be stored in a non-transitory, tangible computer readable storage medium, or any type of media suitable for storing electronic instructions, which may be coupled to a computer system bus. Furthermore, any computing systems referred to in the specification may include a single processor or may be architectures employing multiple processor designs for increased computing capability.

Embodiments may also relate to a product that is produced by a computing process described herein. Such a product may comprise information resulting from a computing process, where the information is stored on a non-transitory, tangible computer readable storage medium and may include any embodiment of a computer program product or other data combination described herein.

Finally, the language used in the specification has been principally selected for readability and instructional purposes, and it may not have been selected to delineate or circumscribe the patent rights. It is therefore intended that the scope of the patent rights be limited not by this detailed description, but rather by any claims that issue on an application based hereon. Accordingly, the disclosure of the embodiments is intended to be illustrative, but not limiting, of the scope of the patent rights, which is set forth in the following claims.

What is claimed is:

1. A system, comprising:

a circuitry configured to:

generate a first rotated component and a second rotated component by rotating a pair of audio signal components;

generate left quadrature components that are out of phase with each other using the first rotated component;

generate right quadrature components that are out of phase with each other using the second rotated component;

generate orthogonal correlation transform (OCT) components based on the left and right quadrature components, each OCT component including a weighted combination of a left quadrature component and a right quadrature component;

generate a mono output channel using one or more of the OCT components; and provide the mono output channel to one or more speakers.

2. The system of claim 1, wherein the circuitry configured to generate the first rotated component includes the circuitry being configured to apply a static angle of rotation to the pair of audio signal components.

3. The system of claim 1, wherein the circuitry configured to generate the first rotated component includes the circuitry being configured to apply a time-varying angle of rotation to the pair of audio signal components.

4. The system of claim 1, wherein:

the left quadrature components have a 90 degrees phase relationship between each other; and the right quadrature components have a 90 degrees phase relationship between each other.

5. The system of claim 1, wherein:

the left quadrature components have a unity magnitude relationship with the first component; and the right quadrature components have a unity magnitude relationship with the second component.

6. The system of claim 1, wherein the circuitry configured to generate the OCT components include the circuitry being configured to:

combine a first left quadrature component with an inverted second right quadrature component to generate a first OCT component;

combine a first left quadrature component with a second right quadrature component to generate a second OCT component;

combine a second left quadrature component with an inverted first right quadrature component to generate a third OCT component; and combine a second left quadrature component with a first right quadrature component to generate a fourth OCT component.

7. The system of claim 1, wherein the circuitry configured to generate the mono output channel includes the circuitry being configured to select an OCT component from the OCT components.

8. The system of claim 1, wherein the circuitry configured to generate the mono output channel includes the circuitry being configured to generate a time varying combination of two or more OCT components.

9. The system of claim 8, wherein the time varying combination of two or more OCT components depends on a slope limiting function that uses a function of the audio signal as an input.

10. The system of claim 1, wherein:

the circuitry configured to generate the mono output channel includes the circuitry being configured to determine a nonlinear sum of a first pair of the OCT components;

the circuitry configured to provide the mono output channel to the one or more speakers includes the circuitry being configured to provide the mono output channel to a first speaker; and the circuitry is further configured to:

generate another mono output channel by determining a nonlinear sum of a second pair of the OCT components, the first and second pairs of OCT components being different; and provide the other mono output channel to a second speaker.

11. The system of claim 1, wherein:

the first audio component is a left subband component of a first subband of the audio signal and the second audio component is a right subband component of the first subband;

the OCT components are of the first subband; and the circuitry configured to generate the mono output channel includes the circuitry being configured to combine the one or more of the OCT components with one or more other OCT components of a second subband of the audio signal.

12. A method, comprising, by a circuitry:

generating a first rotated component and a second rotated component by rotating a pair of audio signal components;

generating left quadrature components that are out of phase with each other using the first rotated component;

generating right quadrature components that are out of phase with each other using the second rotated component;

generating orthogonal correlation transform (OCT) components based on the left and right quadrature components, each OCT component including a weighted combination of a left quadrature component and a right quadrature component;

generating a mono output channel using one or more of the OCT components; and providing the mono output channel to one or more speakers.

13. The method of claim 12, wherein generating the first rotated components includes applying a static angle of rotation to the pair of audio signal components.

14. The method of claim 12, wherein generating the first rotated components includes applying a time-varying angle of rotation to the pair of audio signal components.

15. The method of claim 12, wherein:

the left quadrature components have a 90 degrees phase relationship between each other; and the right quadrature components have a 90 degrees phase relationship between each other.

16. The method of claim 12, wherein:

the left quadrature components have a unity magnitude relationship with the first rotated component; and the right quadrature components have a unity magnitude relationship with the second rotated component.

17. The method of claim 12, wherein generating the OCT components include:

combining a first left quadrature component with an inverted second right quadrature component to generate a first OCT component;

combining a first left quadrature component with a second right quadrature component to generate a second OCT component;

combining a second left quadrature component with an inverted first right quadrature component to generate a third OCT component; and combining a second left quadrature component with a first right quadrature component to generate a fourth OCT component.

18. The method of claim 12, wherein generating the mono output channel includes selecting an OCT component from the OCT components.

19. The method of claim 12, wherein generating the mono output channel includes generating a time varying combination of two or more OCT components.

20. The method of claim 19, wherein the time varying combination of two or more OCT components depends on a slope limiting function that uses a function of the audio signal as an input.

21. The method of claim 12, wherein:

generating the mono output channel includes determining a nonlinear sum of a first pair of the OCT components;

providing the mono output channel to the one or more speakers includes providing the mono output channel to a first speaker; and the method further includes:

generating another mono output channel by determining a nonlinear sum of a second pair of the OCT components, the first and second pairs of OCT components being different; and providing the other mono output channel to a second speaker.

22. The method of claim 12, wherein:

the first audio component is a left subband component of a first subband of the audio signal and the second audio component is a right subband component of the first subband;

the OCT components are of the first subband; and generating the mono output channel includes combining the one or more of the OCT components with one or more other OCT components of a second subband of the audio signal.

23. A non-transitory computer readable medium storing instructions that, when executed by at least one processor, configure the at least one processor to:

generate a first rotated component and a second rotated component by rotating a pair of audio signal components;

generate left quadrature components that are out of phase with each other using the first rotated component;

generate right quadrature components that are out of phase with each other using the second rotated component;

generate orthogonal correlation transform (OCT) components based on the left and right quadrature components, each OCT component including a weighted combination of a left quadrature component and a right quadrature component;

generate a mono output channel using one or more of the OCT components; and provide the mono output channel to one or more speakers.

24. The non-transitory computer readable medium of claim 23, wherein the instructions that configure the at least one processor to generate the first rotated components include instructions that configure the at least one processor to apply a static angle of rotation to the pair of audio signal components.

25. The non-transitory computer readable medium of claim 23, wherein the instructions that configure the at least one processor to generate the first rotated components include instructions that configure the at least one processor to apply a time-varying angle of rotation to the pair of audio signal components.

26. The non-transitory computer readable medium of claim 23, wherein:

the left quadrature components have a 90 degrees phase relationship between each other; and the right quadrature components have a 90 degrees phase relationship between each other.

27. The non-transitory computer readable medium of claim 23, wherein:

the left quadrature components have a unity magnitude relationship with the first rotated component; and the right quadrature components have a unity magnitude relationship with the second rotated component.

28. The non-transitory computer readable medium of claim 23, wherein the instructions that configure the at least one processor to generate the OCT components include instructions that configured the at least one processor to:

combine a first left quadrature component with an inverted second right quadrature component to generate a first OCT component;

combine a first left quadrature component with a second right quadrature component to generate a second OCT component;

combine a second left quadrature component with an inverted first right quadrature component to generate a third OCT component; and combine a second left quadrature component with a first right quadrature component to generate a fourth OCT component.

29. The non-transitory computer readable medium of claim 23, wherein the instructions that configure the at least one processor to generate the mono output channel include instructions that configure the at least one processor to select an OCT component from the OCT components.

30. The non-transitory computer readable medium of claim 23, wherein the instructions that configure the at least one processor to generate the mono output channel include instructions that configure the at least one processor to generate a time varying combination of two or more OCT components.

31. The non-transitory computer readable medium of claim 30, wherein the time varying combination of two or more OCT components depends on a slope limiting function that uses a function of the audio signal as an input.

32. The non-transitory computer readable medium of claim 23, wherein:

the instructions that configure the at least one processor to generate the mono output channel include instructions that configure the at least one processor to determine a nonlinear sum of a first pair of the OCT components;

the instructions that configure the at least one processor to provide the mono output channel to the one or more speakers include instructions that configure the at least one processor to provide the mono output channel to a first speaker; and the instructions further configure the at least one processor to:

generate another mono output channel by determining a nonlinear sum of a second pair of the OCT components, the first and second pairs of OCT components being different; and provide the other mono output channel to a second speaker.

33. The non-transitory computer readable medium of claim 23, wherein:

the first audio component is a left subband component of a first subband of the audio signal and the second audio component is a right subband component of the first subband;

the OCT components are of the first subband; and the instructions that configure the at least one processor to generate the mono output channel include instructions that configure the at least one processor to combine the one or more of the OCT components with one or more other OCT components of a second subband of the audio signal.

* * * * *